US007311787B2

(12) United States Patent
Kruse et al.

(10) Patent No.: US 7,311,787 B2
(45) Date of Patent: Dec. 25, 2007

(54) METHOD FOR THE DARKENING OF A SURFACE LAYER OF A PIECE OF MATERIAL CONTAINING ZINC

(75) Inventors: Thomas Kruse, Dortmund (DE); Peter Meisterjahn, Iserlohn (DE)

(73) Assignee: Ewald Dorken AG (DE)

( * ) Notice: Subject to any disclaimer, the term of this patent is extended or adjusted under 35 U.S.C. 154(b) by 438 days.

(21) Appl. No.: 10/852,870

(22) Filed: May 25, 2004

(65) Prior Publication Data

US 2005/0126921 A1 Jun. 16, 2005

Related U.S. Application Data

(63) Continuation of application No. 09/868,283, filed as application No. PCT/EP99/10036 on Dec. 17, 1999, now Pat. No. 6,758,956.

(30) Foreign Application Priority Data

Dec. 18, 1998 (DE) ..... 198 58 795

(51) Int. Cl.
*C23C 22/60* (2006.01)

(52) U.S. Cl. ..... 148/284; 205/333

(58) Field of Classification Search ..... 205/320, 205/333; 148/284, 287
See application file for complete search history.

(56) References Cited

U.S. PATENT DOCUMENTS

| | | | | |
|---|---|---|---|---|
| 1,953,997 A | | 4/1934 | Cushman et al. | |
| 3,723,102 A | * | 3/1973 | Lowe | 420/34 |
| 4,574,041 A | | 3/1986 | Zahavi et al. | |

* cited by examiner

*Primary Examiner*—Susy Tsang-Foster
*Assistant Examiner*—William T. Leader
(74) *Attorney, Agent, or Firm*—Snell & Wilmer LLP

(57) ABSTRACT

The invention relates to a method for darkening a superficial layer of a workpiece which contains zinc by anodic oxidation. The workpiece is oxidized in a soaking bath containing an aqueous solution comprised of a hydroxide and of a nitrate. The anodic oxidation may be carried out in an aqueous solution containing NH.sub.4 NO.sub.3 or NaNO-.sub.3, and having a pH value ranging from 8 to 14, at a dipping bath temperature (T) ranging from 15 to 45.degree. C., and with a current density (i) ranging from 3.times.10.sup.−4 to 0.5 A/cm.sup.2. The workpiece is placed in the soaking bath at the beginning of the anodic oxidation after the voltage has already been applied.

2 Claims, No Drawings

METHOD FOR THE DARKENING OF A SURFACE LAYER OF A PIECE OF MATERIAL CONTAINING ZINC

CROSS REFERENCE TO RELATED APPLICATIONS

This is a continuation application which claims priority to U.S. patent application Ser. No. 09/868,283, filed on Jun. 15, 2001, now U.S. Pat. No. 6,758,956, under the same title, which claims priority to PCT Application No. PCT/EP99/10036 filed Dec. 17, 1999, which claims priority to International Application No. 198 58 795.3 filed Dec. 18, 1998 which are incorporated herein by reference.

DESCRIPTION

The invention comprises a method for the darkening of a surface layer of a piece of material containing zinc during which the piece of material is oxidized in a dip bath which contains a hydrous solution of a hydroxide and a nitrate, a piece of material treated by such a method, and also the electrolytes for the realization of the method the methods for pretreatment of the pieces of material.

Generally, for the darkening of material surfaces containing zinc, the method known as "blackening by chromating" has been used so far. This method uses the highly reactive molecule of Cr.sub.6 which is, however, according to the most recent findings, strongly detrimental to health.

A less harmful method for the darkening of pure zinc surfaces is described in the scientific paper "production of a protective and decorative coating on zinc by alternating-current treatment at 50 Hz in alkaline solutions" by M. Al. Encheva, published in the J. Appl. Chem. of the USSR 45.318 (1972). In this paper, a dip bath for the darkening of surfaces made of zinc is presented which contains as an electrolyte, within the scope of anodic oxidation, hydrous solutions of NaOH and NaNO.sub.3. This scientific paper is focussed both on the improvement of corrosion resistance of pieces of material with a zinc-coated surface, and on the appearance of the surface-treated pieces of material, especially their transformation.

The quoted paper only mentions rough and wide ranges of parameter for the treatment process, not indicating any details, however, of homogeneity and uniformity of the darkened surfaces. not indicating any details, however, of homogeneity and uniformity of the darkened surfaces. A further development of the familiar method is described, regarding its application on solar collectors, in the published study "Optimization and Microstructural Analysis of Black-Zinc-Coated Aluminium Solar Collector Coatings" by S. N. Patei et al., published in "Thin Solid Firms", 113 (1984), p. 47).

In EP 0 339 578 A1, a process for the production of black-coated steel strips is described which consists of an electrolyte treatment in a dipping bath containing from 75 to 200 g/l of a compound selected from among the group comprising hydroxides, sulphates and chlorides of sodium, potassium or nickel. Preferably, the dip bath contains nitrate ions in a quantity from 2 to 100 g/l. For the anodic oxidation used for this process, current densities within the range from 30 to 200 A/cm.sup.2 are used. This process is preferably operated with alternating current. The dipping bath must absolutely contain both an inhibitor substance and a complex-forming one.

FR 2758339 A describes a method for anti-corrosion treatment of metallic workpieces, in particular ferruginous ones. The dip bath used for electrolysis contains between 300 to 700 g/l of alkali hydroxides, between 20 and 50 g/l alkali nitrates and/or nitrites, between 40 to 100 g/l borax, and between 10 to 40 g/l tensides, the dipping bath bring maintained at a temperature within the range from 110 to 130.degree. C.

The scientific paper by Fry H. E. A. with the title "The Anodic Oxidation of zinc and a Method of Altering the Characteristics of the Anodic Films", published in "Journal of the Electrochemical Society", volume 106, No. 7, July 1959, pages . . . 606-611, equally describes methods of anodic oxidation of zinc. Black coatings have been achieved by anodizing zinc in a sodium hydroxide solution with a current density of about 200 mA/cm.sup.2. Dark layers were apparent in case of dip bath solutions containing sodium carbonate and sodium hydroxide, if low anode potentials were used. All samples were immersed into the bath for 15 seconds without voltage and prior to feeding the potential.

From this starting point, the invention is based on the purpose to develop processes for the darkening of a surface layer of a piece of material containing zinc in such a way that all treated surfaces show increased homogeneity adhesion and uniformity, and also to provide the respective piece of material having such properties, and also the electrolytes for the execution of such processes.

The requirement is met by a method according to claim 1. The dip bath solution preferably contains an alkali salt or ammonium salt from among the group comprising phosphates, acetates, carbonates, sulphates, exalates, citrates and borates of alkali metal or ammonium.

If these process parameters are maintained, the result is the homogenous darkening of the surface layers of the surfaces of those pieces of material which contain zinc from a dark gray colour to black, leading also to an excellent homogeneity of the surface layer. It should be emphasized that it is a comparatively low current density which will lead to the desired colour changes of the surface layers, quite contrary to the method described in the scientific paper.

The method is characterized by the piece of material being immersed into the dip bath of a device which is equipped with, at least, two electrodes for anodic oxidation, the alternating or direct voltage being fed to the electrodes prior to immersion of the piece of material into the bath, and only then the piece of material will be immersed into the bath while maintaining the voltage which should initially be 8 volts for alternating current and initially 20 volts for direct current with an electrode spacing of 3 cm. When the piece of material is immersed, first a high current will flow between the electrodes. After the expiry of a period of a few seconds after immersion of the piece of material, the current density required for this method should be adjusted by reducing the voltage. Such a method will essentially contribute to the homogeneity of the darkened surface layer. It is important to provide of a minimum current flowing during immersion of the piece of material for the purpose of improvement of homogeneity.

Appropriate pieces of material could be all suitable substrates which are coated with a zinc layer whose surface has been treated, and also pure zinc. Instead of pure zinc, you could use a zinc alloy presenting, in relation to the dry layer, a high content of zinc, e.g. a minimum of 50 percent in weight. Additionally, it is possible to apply a pure zinc layer, or a zinc alloy layer by any other method to a substrate, such as vapor deposition processes like PVD and CVD, hot dip galvanizing and all methods for mechanical surfacing of such layers. In individual cases, mat zinc-coated or bright galvanized steel sheets may be used. Possible zinc alloys may be, among others, Zn/Fe, Zn/Ni, Zn/Fe/Co, Zn/Co, Zn/Al, Zn/Sn, Zn/Mn.

Titanium may be used as the opposite electrode for the piece of material to be treated. Other materials could also be used for the electrodes if the required current density is adapted accordingly. Other possible materials for the opposite electrode are precious metals, stainless steel, tantalum, graphite.

The pH value should preferably be adjusted by means of the respective concentration of NaOH or KOH. The pH value will be finally decisive, while, for providing the OH' groups, it is also possible to use amines or other organic bases, soluble potassiums (sodium silicates, potassium silicates, lithium polysilicates), amino hydrosilicones, basified titanic acid esters (silica esters) in single or combined form. Optionally, zirconium compounds which are made available/resembling? (for) groups similar to OH' may be used [Sense? Translator's remark].

For acceleration of the treatment process, the pH value should be higher than 13. This is also applicable for all methods relating to the invention which are described later on. In this case, . . . anodic oxidation may be processed over a treatment period of from 1 second to 10 minutes until the surface layer has darkened.

The method can optionally be carried out with direct voltage or alternating voltage. Generally, for operation with direct current, lower current densities will be required for achieving darkening of the surface layer.

When operating the process with direct voltage, the temperature of the bath may be within the range from 15 to 45.degree. C., while the current density is within the range from 0.003 to 0.15 A/cm.sup.2. Working with direct voltage has the advantage of good results of surface layer darkening being obtained even at room temperature and with very low current density.

Alternately, the bath temperature may be equal to from 35 to 45.degree. C. when operating the process with alternating voltage, while the current density is within the range from 0.1 to 0.15 A/cm.sup.2.

Recommendations about temperatures and composition of the dip bath for anodic oxidation with direct or alternating current are indicated in the claims.

The process described above may also be supplemented by pretreatment steps, where any structural non-homogeneities of the surfaces of the piece of material or high organic parts can be accounted for. In both cases, the piece of material is subjected to a dip treatment (activating/decopying) in some acid, prior to anodic oxidation.

For the removal of any visible structural non-homogeneities, you can use, as an acid, H.sub.2 SO.sub.4 which is at least 0.5 molar, carrying out the dipping treatment over a period of a minimum of 10 seconds. The period of treatment will depend on the visible impression presented by the surface layer on visual inspection.

Particularly when a high portion of organic parts is contained in the surface layer, you can use as an acid 2 molar H.sub.2 SO.sub.4 for a pretreatment step. Afterwards you can temper the piece of material at a temperature of about 200.degree. C., the period of such a pretreatment being in the range of 1 hour.

All of the pretreatment steps described above are particularly suitable with pieces of material whose surface layer is made of bright zinc. The brighteners used for the production of bright zinc may be responsible for a high organic portion in the surface so that no sufficiently darkened appearance of the surface layer will be achieved.

After anodic oxidation, the quality of the appearance of the surface layer may be improved by an after-treatment step where the piece of material is also exposed to acid in a dipping process. Such a secondary treatment may, for instance, be related to the presence of iridescent films on the darkened surface layer which deteriorate the optical impression of the surface layer.

For the prevention of such iridescent films, in particular, the piece of material may be dipped into a 10 percentage CH.sub.3 COOH, maintaining the dipping over a period of at least 30 seconds. Good results have been achieved with . . . a period of one minute for the dipping treatment.

A bipolar method is also possible, both electrodes for anodic oxidation being formed by a piece of material whose surface contains zinc, i.e. the opposite electrode being equally present as a piece of material whose surface is to undergo treatment as well. This will about double the production rate achieved for pieces of material with darkened surfaces.

When pieces of material are surface-treated which have been galvanized with pure zinc, an average thickness of a minimum of 8 .mu.m of the contact surface layer may be of advantage. This relates, in particular, to such pieces of material which form the components of a frame. Such frame components will have edges whose surface treatment may be difficult. The mentioned average contact surface thickness will help to maintain corrosion resistance, in particular.

Particularly good results for darkening the surface layer of pieces of material can be achieved if the surface layer contains at least 50 percent in weight of zinc.

Another object of the invention includes a piece of material which is produced with the processes described above and surface treated. The zinc-containing surface is characterized by its transformation in structure by anodic oxidation in such a way that the result will be a very to high absorption capacity, for instance, in the visible spectral region, thus making the surface seem blackened. The thickness of the transformed part of surface layer of the piece of material is within the range of between several .mu.m and several 100 .mu.m, preferably between approx. 5 to 500 . . . .mu.m. A very low degree of reflection can be adjusted, especially for infrared radiation. Moreover, the transformed surface layer is characterized by adhesion in itself and to the adjacent material providing therefore a good solidity.

The provision of the OH' groups can preferably be adjusted by a respective concentration of NaOH or KOH. The electrolyte may also contain additives for antifoaming, for the improvement of subsurface wetting or corrosion inhibitors in solid or liquid consistency in a concentration of 0.01-100 g/l. Suitable organic solvent additives will be glycols, glycol ether, glycol ether ester, and alcohols of any kind according to their use, which may be present by themselves or in concentration with each other.

Included as another object of the invention is a process for the darkening of a surface layer of a piece of material containing zinc, the material being subjected to a treatment in a dipping without the use of electrolytic effects, the dip bath containing a hydrous solution of a hydroxide and a nitrate, the hydrous solution having . . . a pH value within the range from 8 to 14 and a concentration of NH.sub.4 NO.sub.3 or NaNO.sub.3 within the range from 40 to 50 g/l, the dipping being carried out at a temperature within the range from 15 to 45.degree. C.

When carrying out the last-mentioned process, the pH value of the dip bath should be higher than 13, the bath temperature should be within the range from 15 to 25.degree. C., and the period of treatment should not fall below 10 seconds. If you use, for instance, an electrolyte containing NaOH in a concentration of 30 g/l, and NaNO.sub.3 in a concentration of 40 g/l, the process being carried out at room temperature, darkening of the ZnFe surface layer is obtained as early as after 20 to 30 seconds. The iron portion on the ZnFe will be, for instance, within the range from 0.3 to 1.5 percent in weight.

The above-mentioned specified task is equally fulfilled by a process for the darkening of a surface layer of a piece of material containing zinc, during which the piece of material is subjected to anodic oxidation in a dip bath containing a hydrous solution of a hydroxide, where the dipping bath has a pH value within the range from 8 to 14, the process is carried out with direct current at a current density of within the range from 2 to 30 mA/cm.sup.2, and the piece of material is immersed into the dipping bath at the beginning of anodic oxidation when voltage has already been fed.

It could be observed that, when the current density is lower than . . . 2 mA/cm.sup.2 no darkening will occur, while, when 30 mA/cm.sup.2 are exceeded, at first darkening will occur, but the relevant layer will then dissolute again within a few seconds. Preferably an alkali hydroxide should be used whose pH value should be higher than 13.

The provided methods and the pieces of material produced by these processes offer the following benefits: the use of harmful Cr.sub.6 can be avoided; the compatibility with commercial galvanizing techniques is ensured (like, for instance, aluminium anodizing methods), and therefore well-known plant engineering (frame-type or barrel-type methods) including the associated know-how can be used to a large extent; and, in case you intend to overpaint the piece of material with, for instance, a transparent, dark, or black, if any, paint system on the basis of organic or inorganic binders, the contrast difference of the paint layer to the transformed surface of the piece of material is low so that low expenditure of material is required for reaching hiding capacity for the surface of the piece of material.

Some typical design examples of the processes included in the invention and the pieces of material treated according to these are explained in the following for better comprehension of the invention.

On the examples of design explained below, the piece of material each used will be a bright galvanized steel sheet. If not otherwise stated, the steel sheet is dipped into the respective dipping bath when voltage is applied to it.

EXAMPLE 1

The first processing step for surface treatment of the piece of material is its immersion into 0.5 M H.sub.2 SO.sub.4 for about one minute. This step of the process is used for . . . improving homogeneity of the surface to be treated later on in a process of anodic oxidation and will be required only if the material surface to be treated presents unusual non-homogeneities.

In a second process step, anodic oxidation of the piece of material is carried out (electrode spacing: 3 cm; a few volts of alternating voltage), all opposite electrodes being made of titanium sheet. For anodic oxidation, a dip bath is being used which is characterized by a hydrous solution of NaOH and NaNO.sub.3 as an electrolyte, the selection of concentrations being the following: 30 g/l of NaOH and 40 g/l of NaNO.sub.3. The bath temperature T is 40.degree. C., while the current density i is equal to 0.1 A/cm.sup.2. The treatment period is within the range from 2 to 10 minutes.

For anodic oxidation in this example of design, the piece of material will form the collector electrode of an alternating current circuit which is operated with 50 Hz alternating current, while the titanium sheet acts as the opposite electrode.

In a third process step, the piece of material is removed from the dip bath in anodic oxidation, cleaned in a flushing process which may consist of multiple stages, if any, and dried finally.

The process of anodic oxidation will transform the surface layer of the piece of material in order to result in a homogeneous structure and a uniformly darkened surface layer colour. The thickness of the transformed part of surface layer will depend in the first place from the treatment period t and will be within the range of several 10 to several 100 nm. The transformed surface layer provides self-adhesion in itself and firm adhesion to the surface of the non-transformed . . . zinc.

EXAMPLE 2

The second process step may also be carried out with the following parameters, keeping to the above-mentioned treatment period t, the titanium sheet opposite electrode and the bath temperature T: electrolyte composition 13 g/l NaOH and 50 g/l in water; current density i 0.05 A/cm.sup.2. The result are pieces of material with transformed surface, their properties being equal to those which have been explained with Example 1) for the second process step.

Both of the described examples of execution for the second process step are contained within a limiting range for the process parameters of NaOH concentration, NaNO.sub.3 concentration, and current density. These parameters may be changed within the limits described above, the surface layer quality being maintained to a substantial extent.

The bath temperature T and treatment period t may be altered according to each application, as well.

EXAMPLE 3

While using the same second process step as described in examples 1) and 2), the first process step will be modified in such a way as to remove any disturbingly high organic parts from bright galvanizing of the steel sheet.

For this purpose, the first process step will consist of a dipping process into 2 M H.sub.2 SO.sub.4 for more than 10 seconds, for example for up to 2 minutes. The first process step will also comprise the tempering of the piece of material at about 200.degree. C. The tempering step lasts for about 1 hour.

EXAMPLE 4

This example accounts for the fact that, although the process steps are carried out as explained above and according to examples 1) to 3), it may be possible that, after anodic oxidation, iridescent films occur on material surface, especially in the case of bright galvanized steel sheet.

To avoid such iridescent films, the piece of material is subjected to a dipping treatment in 10 percentage CH.sub.3 COOH over a period of at least 3 seconds.

EXAMPLE 5

Contrary to Example 1), this example shows a process carried out with direct voltage. The piece of material will again be a bright galvanized steel sheet.

Process parameters include the following: Electrolyte: 30 g/l of NaOH, 40 g/l NaNO.sub.3 in water. Direct current density is 0.017 A/cm.sup.2, while the period of treatment takes 5 minutes.

Bath temperature is equal to room temperature. This example will have the particular advantage that lower current density, as compared to alternating voltage, can be used for the process. Moreover, the formation of hydrogen which will be produced in the cathodic half-wave when processing with direct voltage, can be totally avoided when using direct voltage for the process. Hydrogen may lead to an embrittlement of the surface layer of the piece of material.

The following example makes evident how to achieve the darkening of a surface layer of a piece of material without electrolytic effects.

EXAMPLE 6

This example has been carried out on a piece of material with a surface layer made of ZnFe, where the part of iron is within the range from 0.5 to 1.5 percent in weight.

The process is carried out without current at room temperature, the electrolyte containing 30 g/l of NaOH and 40 g/l of NaNO.sub.3.

After 20 to 30 seconds of dipping, darkening of the surface layer will occur on the piece of material.

EXAMPLE 7

Contrary to the examples described above, for this process, a second piece of material is used as the opposite electrode, which substantially has the same structure as the piece of material to be processed, thus facilitating bipolar operation. Both pieces of material will be treated simultaneously, resulting, as above, in darkened surface layers when alternating voltage is fed.

EXAMPLE 8

With a pH value within the range from 13.4 to 13.6, zinc layers which have been applied by galvanization, are anodized when alternating current within the range from 0.1 to 0.15 A/cm.sup.2 is applied. For the following sodium salts, a darkening of surface providing good homogeneity has been observed: sodium phosphate (10-40 g/l), sodium acetate (10-40 g/l), sodium carbonate (10 g/l), sodium phosphate (10-40 g/l), sodium oxalate (10-40 g/l), sodium citrate (10-40 g/l), and sodium borate (10-40 g/l).

It is totally conceivable to use salt concentrations of up to 60 g/l, at least. With sodium borate, a minimum current density of 0.05 A/cm.sup.2 is sufficient for blackening the surfaces.

EXAMPLE 9

At a pH value within the range from 13.8 to 13.95, the darkening of surfaces containing zinc is possible if the same values of current and salt concentration as in the previous example are used. With both sodium nitrate and sodium borate, surface blackening can be observed. All other alkali salts mentioned in the previous example will lead to a dark gray colour change.

Regarding the execution of anodic oxidation with alternating voltage, the two examples mentioned last show a difference regarding the salts used for achieving a satisfactory degree of darkening. The difference is related to NaOH concentration. If you use NaOH concentrations within the range from 10 to 15 g/l, other salts with good darkening results, besides sodium nitrate and sodium borate, can be used, such as phosphates, acetates, carbonates, sulphates, oxalates, citrates of alkali metals or ammonium. The best results of darkening can be achieved with the salts sodium nitrate and sodium borate, when compared to this, if the NaOH concentration range exceeds 30 g/l.

The dipping bath may also contain several salts without the darkening result being deteriorated, for instance, a mixture of sodium nitrate and sodium borate.

EXAMPLE 10

If the pH value is within the range from 13.4 to 13.6, surfaces containing zinc were anodized with direct current. Darkening, or even blackening, with a good surface homogeneity has already been observed at current densities within the range from 3.times.10.sup.−4 to 20.times.10.sup.−3 A/cm.sup.2, depending of the salt used each time. In particular, when using sodium borate and sodium nitrate, black surfaces with good homogeneity . . . can be obtained.

Concerning the execution of anodic oxidation with direct current, far better results can be achieved with the salts sodium nitrate and sodium borate than with any other alkali or ammonium salts.

EXAMPLE 11

It is, however, quite possible to achieve darkening of a surface containing a minimum of 50% zinc by using pure NaOH. A hydrous solution with 30 g/l NaOH and a current density of 15 mA/cm.sup.2 direct current, anodic oxidation will lead to surface darkening.

Therefore, the salts studied in the previous examples seem, in the first place, to increase the current density interval for the darkening of a surface layer containing zinc.

The invention claimed is:

1. Process for the darkening of a surface layer of a piece of material, the surface layer consisting of zinc, during which the piece of material is subjected to a treatment in a dipping bath containing an aqueous solution consisting of water, a-hydroxide and a nitrate, the nitrate selected from the group consisting of $NH_4NO_3$ and $NaNO_3$, the aqueous solution having a pH value within the range from 9 to 14, the nitrate having a concentration within the range from 40 to 50 g/l, and the dipping bath being carried out at a temperature (T) within the range from 15 to 45° C.

2. Process according to claim 1, characterized by the pH value of the bath exceeding 13, the bath temperature being within the range from 15 to 25° C., and the treatment period being minimum 10 seconds.

* * * * *